US008380474B2

(12) United States Patent
Hovadik et al.

(10) Patent No.: US 8,380,474 B2
(45) Date of Patent: Feb. 19, 2013

(54) LOCATION OF BYPASSED HYDROCARBONS

(75) Inventors: Joseph Martin Hovadik, San Leandro, CA (US); Julian Thorne, Orange, CA (US); David K. Larue, Newport Beach, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1096 days.

(21) Appl. No.: 12/169,034

(22) Filed: Jul. 8, 2008

(65) Prior Publication Data

US 2010/0010796 A1 Jan. 14, 2010

(51) Int. Cl.
*G06F 7/60* (2006.01)
*G06G 7/48* (2006.01)

(52) U.S. Cl. ..... 703/10; 703/2

(58) Field of Classification Search ..... 703/2, 10
See application file for complete search history.

(56) References Cited

U.S. PATENT DOCUMENTS

| | | | | |
|---|---|---|---|---|
| 4,181,176 | A | 1/1980 | Frazier | |
| 4,676,313 | A | 6/1987 | Rinaldi | |
| 5,633,590 | A * | 5/1997 | Vail, III | 324/368 |
| 5,711,373 | A * | 1/1998 | Lange | 166/252.2 |
| 5,823,631 | A * | 10/1998 | Herbolzheimer et al. | 299/4 |
| 6,856,132 | B2 | 2/2005 | Appel et al. | |
| 2008/0136409 | A1 | 6/2008 | Sen et al. | |

OTHER PUBLICATIONS

"Fast Marching Methods: A boundary value formation", J.A. Sethian. Copyright 1996-2010.*

Sethian, J. A., A fast marching level set method for monotonically advancing fronts, Pro. Natl. Acad. Sci. USA., vol. 93, pp. 1591-1595, Feb. 1996.

Larue, D.K. and Legarre, H. Flow Units, connectivity and reservoir characterization in a wave-dominated deltaic reservoir: Meren reservoir, Nigeria, The American Association of Petroleum Geologists, V. 88, No. 3, 303-324, Mar. 2004.

Larue, D.K., Outcrop and Waterflood Simutlation Modeling of the 100-Foot Channel Complex, Texas, and the Ainsa II Channel Complex, Spain: Analogs to Multilateral Channelized Slope Reservoirs, in Integration of outcrop and modern analogs in reservoir modeling, AAPG Memoir 80, p. 337-364, 2004.

Hovadik, J.M. and Larue, D.K. Static characterizations of reservoirs: refining the concepts of connectivity and continuity, Petroleum Geoscience, vol. 13, pp. 195-211, 2007.

International Search Report, PCT/US2009/047896, Jun. 19, 2009, 3 pages.

* cited by examiner

*Primary Examiner* — Omar Fernandez Rivas
*Assistant Examiner* — Nithya Janakiraman
(74) *Attorney, Agent, or Firm* — Carlos L. Hanze

(57) ABSTRACT

A method of locating resources in a reservoir that includes at least one injection well and at least one production well includes mapping a modeled permeability characteristic of structures making up the reservoir, computing, based on the modeled permeability characteristic, an indicator of flow velocity for streamlines from each production well, computing, based on the modeled permeability characteristic, an indicator of flow velocity for streamlines from each injection well, and combining the indicators of flow velocity from each production and injection well to characterize a sweep efficiency of the reservoir system.

15 Claims, 4 Drawing Sheets

LOCATION OF BYPASSED HYDROCARBONS

BACKGROUND

1. Field of the Invention

The present invention relates generally to analysis of geological data and more particularly to identification of a bypassed portion of an already exploited region.

2. Description of the Related Art

In oil and gas production operations, it is important to produce as much as possible of the available resources from each drilling operation. In a given well field, it can be quite common that recoverable amounts of hydrocarbon are bypassed during production. On initial drilling of a particular formation, oil may be produced by primary production methods that take advantage of pre-existing pressure in the formation. Once primary production has been completed, there is often still a high degree of oil saturation. Secondary recovery approaches are then used to recover more oil from the formation. Fluid injection is one approach that has been used to promote flow of hydrocarbons from remote areas of the field to a production well. In fluid injection, water is pumped into certain wells, pressurizing the reservoir and causing additional production from the production wells. Even where fluid injection is used, there can be regions of the field that remain bypassed that may include significant hydrocarbon resources.

In this regard, reservoir connectivity has been studied, to provide an understanding of what effects should be expected when injecting fluid at a particular point within the formation. In conjunction with permeability models, connectivity models can be used to model fluid flow through the formation, providing insight on where to perform fluid injection or where to drill additional production wells, for example.

SUMMARY

Aspects of embodiments of the present invention provide a method of locating resources in a reservoir, the reservoir including at least one injection well and at least one production well, including mapping a modeled permeability characteristic of structures comprising the reservoir, computing, based on the modeled permeability characteristic, an indicator of time of flight for streamlines from each production well, computing, based on the modeled permeability characteristic, an indicator of time of flight for streamlines from each injection well, combining the indicators of time of flight from each production and injection well to characterize a sweep efficiency of the reservoir system, and identifying areas of high time of flight as areas that are likely to include bypassed hydrocarbons in the reservoir.

Aspects of embodiments of the invention may include a computer-readable medium encoded with computer-executable instructions for performing the foregoing method or for controlling the foregoing system.

Aspects of embodiments of the invention may include a system incorporating the foregoing system and configured and arranged to provide control of the system in accordance with the foregoing method. Such a system may incorporate, for example, a computer programmed to allow a user to control the device in accordance with the method, or other methods.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various FIGS. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

As described above, a reservoir may include both injection and production wells. It may be useful to understand how the injection and production wells are interconnected within the subsurface. In particular, in addition to a general understanding of the permeability of the material of which the formation is made, stratigraphic and structural components can affect the ability of fluid to migrate from the injection wells to the production wells. Such components can include disconnected geobodies, flow barriers, and reservoir compartmentalization, all of which can lead to bypassed oil.

Figure 1:
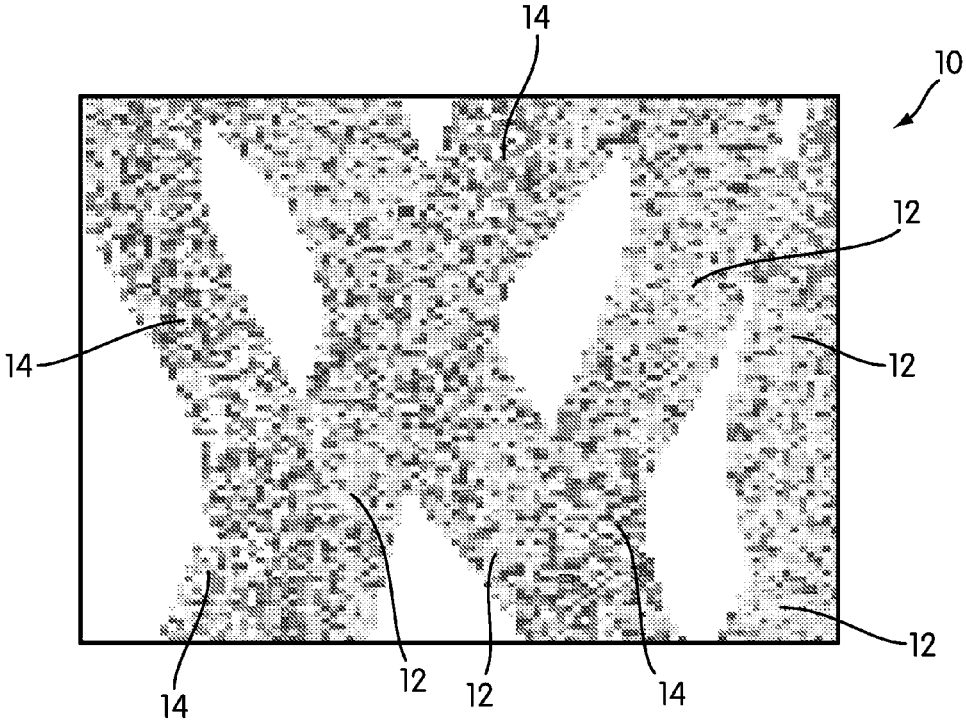
FIG. 1 illustrates a permeability model for a reservoir region of interest to be analyzed in accordance with an embodiment of the present invention.

The permeability of the subsurface formations can be determined in part by core samples, well logs and other techniques. In general, however, it is impractical to empirically determine permeability throughout a region of interest. As a result, it is common to use modeling techniques as the basis for a permeability map of the subsurface region. A portion of a permeability model 10 for a region of interest is illustrated in FIG. 1. Permeability of each cell of the modeled space is represented by a color (in this case, grey) scale. In this example, areas of higher permeability are indicated by the reference numbers 12, while areas of lower permeability are shown at reference numbers 14.

Based on the permeability models, calculations may be performed to determine a time of flight (TOF) from or to a particular region. TOF may be thought of as a combination of geometrical distance between two points with permeability information, to determine a permeability-weighted path length between the points.

In this regard, a fast marching algorithm may be applied to the permeability model in order to calculate TOF between each point of the region and selected references. A useful approach is to select either production or injection wells as source/destination points and to calculate TOF to the remainder of the field relative to the wells.

The fast marching algorithm can be applied to the permeability model as described above, or to a velocity model based on the Darcy flow equation in order to calculate the TOF field.

In either case, the essence is the production of a permeability weighted path-length between points of interest within the region.

Figure 2:
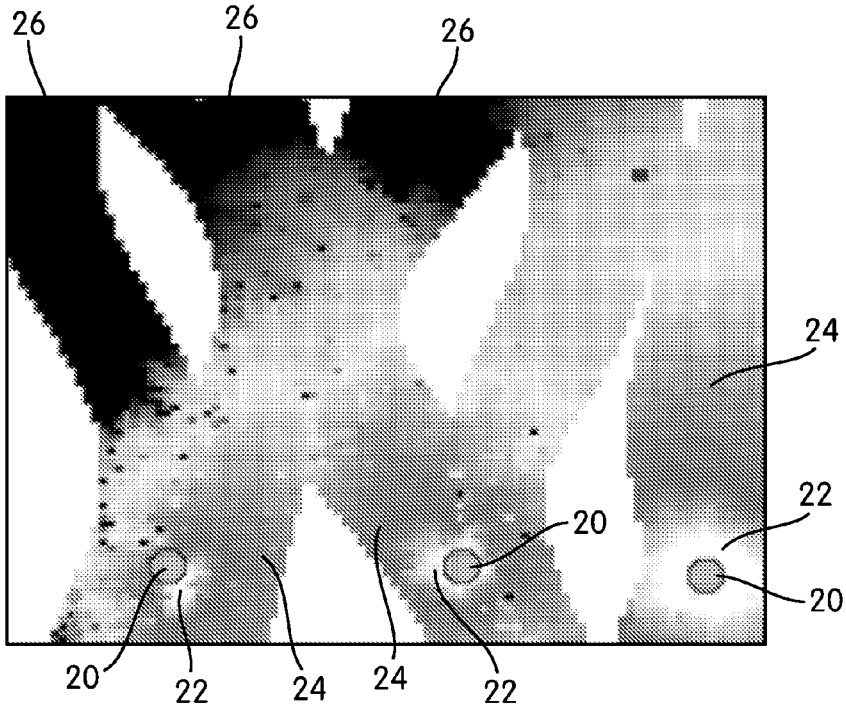
FIG. 2 illustrates a time of flight map for the reservoir region of FIG. 1 using production wells as the origin.

FIG. 2 is an example of a TOF diagram in accordance with the above description. In this case, the map illustrates a TOF from a number of production wells 20. As will be appreciated, the bright regions 22 adjacent the wells 20 represent very short times of flight. In the case of these regions, proximity dominates over the permeability effects. On the other hand, permeability effects are still visible. For example, the left-most well has a bright region only in two of four quadrants, and the overall bright region is relatively small. In comparison, the right-most well has a large bright region extending through all four quadrants. This is in accord with the permeability model of FIG. 1, which shows the right-most well in a region of generally high permeability 12, while the left-most well is adjacent a region of low permeability, particularly on its North and West sides.

Regions of somewhat short times of flight (i.e., longer than the brightest regions 22, but still fairly short) are shown by reference number 24. As can be seen, these regions correlate well to the regions of high permeability 12 as well, though they tend to be somewhat more geometrically distant from the wells 20.

The black regions 26 in the upper left portion of the FIG. correspond generally to geometrically distant portions of the reservoir that additionally are separated from the wells by low permeability regions 14 as shown in FIG. 1.

Figure 3:
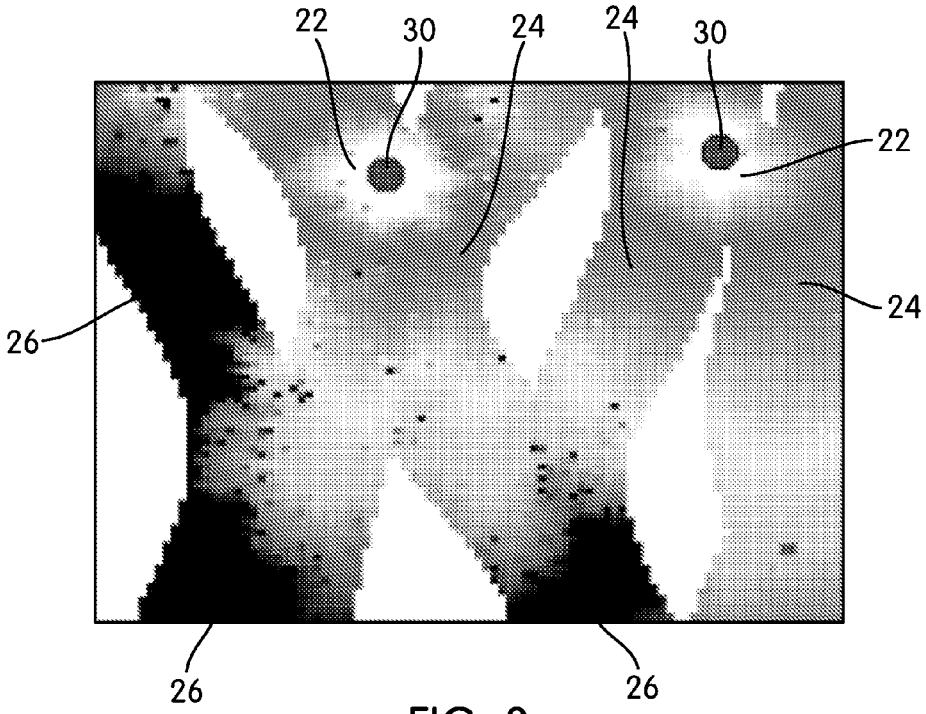
FIG. 3 illustrates a time of flight map for the reservoir region of FIG. 1 using injection wells as the origin.

FIG. 3 is a similar TOF diagram for injection wells 30. As in FIG. 2, regions of very short TOF 22 are brightest. Likewise, regions of low, but not as low, TOF 24 are a somewhat dark grey, and regions of very high TOF 26 are black.

Figure 4:
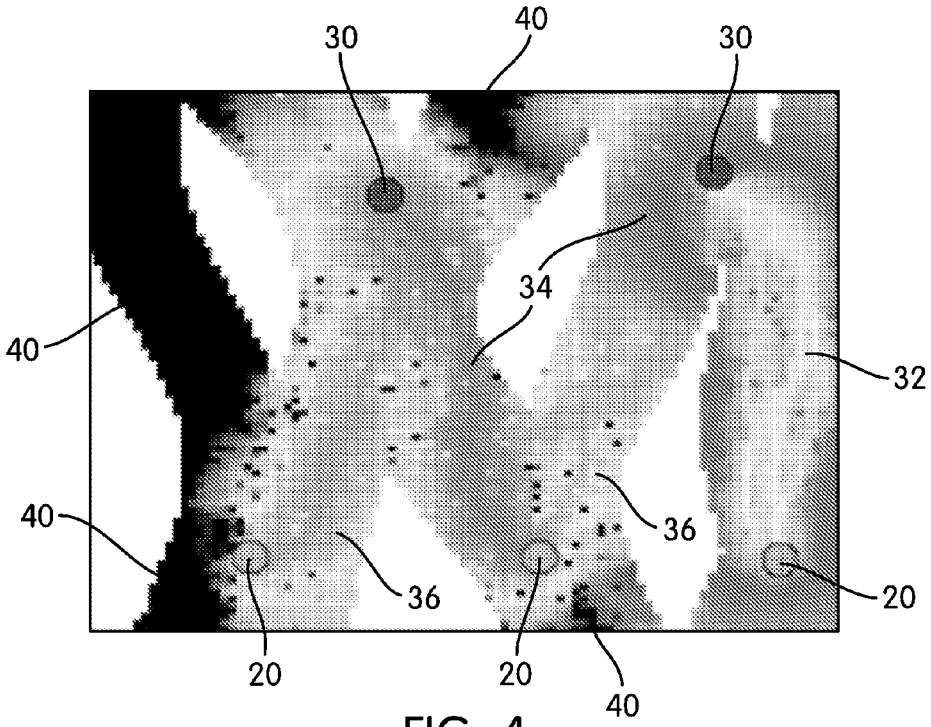
FIG. 4 illustrates a combined time of flight map for the reservoir region of FIG. 1 based on a summation of the times of flight from FIGS. 2 and 3.

FIG. 4 represents a summation of the TOFs of FIGS. 2 and 3. When the two sets of information are combined, an understanding of the general paths of fluid between the injection and production wells can be achieved.

As seen in FIG. 4, a region of shortest aggregate TOF 32 connects the right-most injection well 30 and production well 20. Other regions of relatively short aggregate TOF 34, 36 are evident from the combined data. Moreover, regions of extremely high TOF 40 are also notable.

Once the pathways between the injection and production wells are understood in this fashion, it is possible to identify regions that are more likely to include bypassed oil. As will be appreciated, the path at 32 on the right-hand side of the reservoir is not likely to include much bypassed oil, as it represents a relatively free-flowing region. Likewise, the left hand portion 34 appears to indicate a free-flowing region between the left injection well 30 and the central production well.

On the other hand, long TOF areas 40 may be good candidates for further drilling, as the current injection-production environment does not appear to be likely to be efficiently pushing oil to the existing production wells.

In principle, a decision on where to drill additional wells could be made based strictly by applying a threshold to the combined TOF data. In this approach, regions with TOFs larger than the threshold value are candidates for drilling. However, because long TOFs may indicate physical barriers to production over a wide region, rather than simply poor connectivity to the existing well network, a simple threshold approach is likely to result in unfavorable results.

One approach that may supplement the combined TOF data is to take into account information relating to current production at the production wells in order to calibrate the TOF results and determine which regions represent anomalously high TOFs. This may involve, for example, user interpretation of both the TOF data and the current production data.

Figure 5:
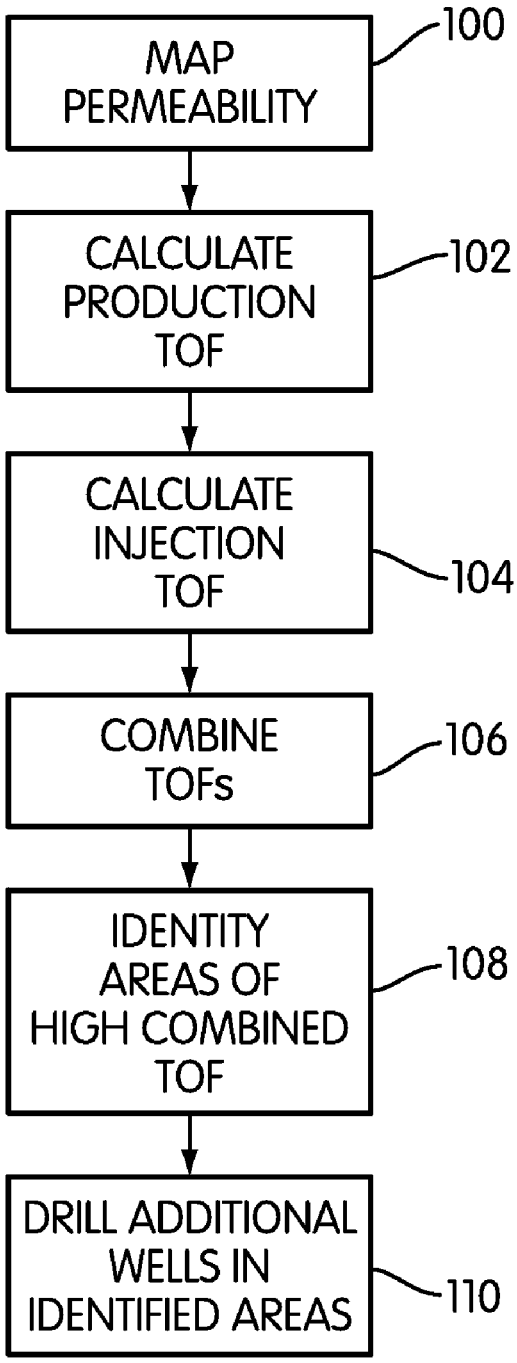
FIG. 5 is a flow chart illustrating a method in accordance with an embodiment of the present invention.

A method of locating resources in a reservoir is illustrated in the flow chart of FIG. 5. For a reservoir that includes at least one injection well and one production well, permeability is mapped 100 as described above. For streamlines (i.e., a path of fluid flow in the flow modeling) from each production well, an indicator of time of flight is computed 102. Likewise, from each injection well, an indicator of time of flight is computed 104. As will be appreciated, these two steps can be performed in either order without affecting the operation of the method described.

Once the two time of flight calculations are computed, they are combined to characterize a sweep efficiency of the reservoir system 106. Finally, based on the sweep efficiency, areas of high time of flight may be identified as areas that are likely to include bypassed hydrocarbons 108. Based on the identification, additional injection and/or production wells may be drilled 110.

Figure 6:
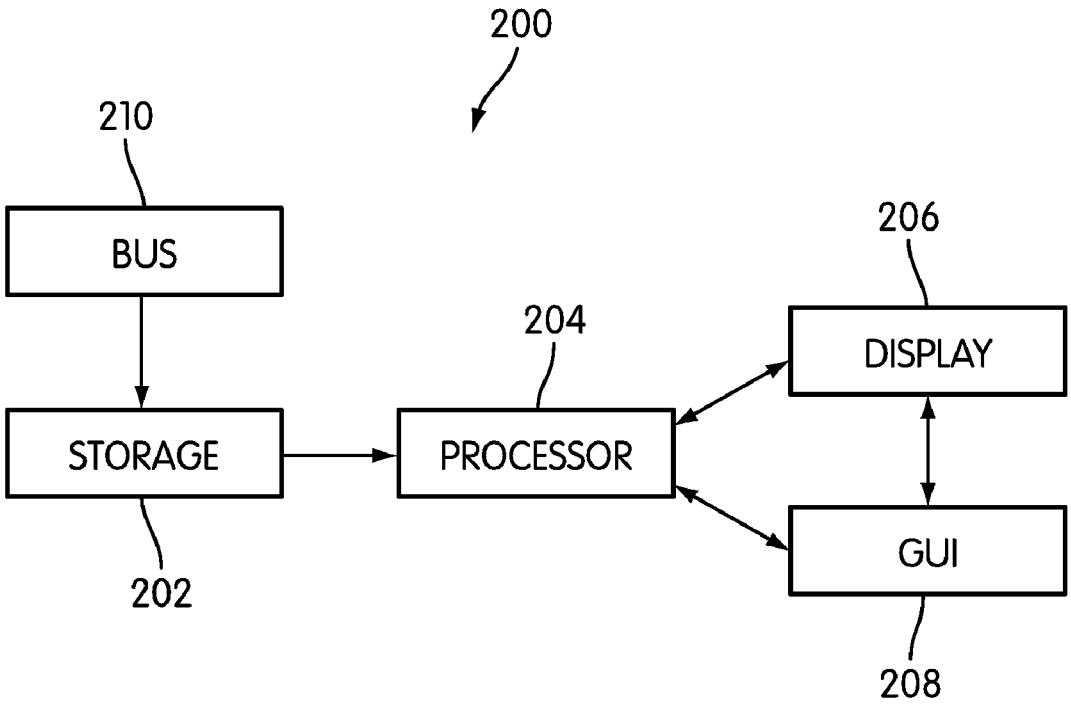
FIG. 6 is a schematic illustration of an embodiment of a system for performing methods in accordance with embodiments of the present invention.

A system for performing the method is schematically illustrated in FIG. 6. A system includes a data storage device or memory 202. The stored data may be made available to a processor 204, such as a programmable general purpose computer. The processor 204 may include interface components such as a display 206 and a graphical user interface 208. The graphical user interface may be used both to display data and processed data products and to allow the user to select among options for implementing aspects of the method. Data may be transferred to the system 200 via a bus 210 either directly from a data acquisition device, or from an intermediate storage or processing facility (not shown).

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, though reference is made herein to a computer, this may include a general purpose computer, a purpose-built computer, an ASIC programmed to execute the methods, a computer array or network, or other appropriate computing device. As a further example, it is to be understood that the present invention contemplates that, to the extent possible, one or more features of any embodiment can be combined with one or more features of any other embodiment.

What is claimed is:

1. A computer-implemented method of locating resources in a reservoir, the reservoir including at least one injection well and at least one production well, comprising:

defining discrete points in a reservoir;

defining a region of interest in the reservoir;

mapping a modeled permeability characteristic of structures comprising the reservoir;

computing, via a computer, based on the modeled permeability characteristic, an indicator of time of flight for streamlines from each production well to each point;

computing, via a computer, based on the modeled permeability characteristic, an indicator of time of flight for streamlines from each injection well to each point;

combining, via a computer, the indicators of time of flight from each production well and each injection well to characterize a sweep efficiency of the reservoir wherein combining comprises combining the production well and injection well indicators of time of flight at each point within the region of interest of the reservoir;

mapping, via a computer, the combined indicators of time of flight for the region of interest;

displaying, via a computer, the mapped indicators of time of flight using a color scale, wherein the color scale provides a visual identification of areas of the reservoir that are likely to include bypassed resources; and identifying areas of high time of flight as the areas of the reservoir that are likely to include bypassed hydrocarbons in the reservoir.

2. A method in accordance with claim 1, wherein the permeability characteristic comprises a velocity model.

3. A method in accordance with claim 1, wherein the permeability characteristic comprises a gradient of a pressure model.

4. A method in accordance with claim 1, wherein time of flight is computed using a fast marching algorithm.

5. A method in accordance with claim 1, wherein the combining comprises summing the production well and injection well times of flight at each point.

6. A method in accordance with claim 5, further comprising, identifying areas having a summed time of flight that exceeds a threshold value as areas of the reservoir that are likely to include bypassed resources.

7. A method in accordance with claim 6, further comprising, drilling into the identified areas to access the bypassed resources.

8. A computer-implemented method of locating hydrocarbon resources in a reservoir, the reservoir including at least one injection well and at least one production well, comprising:

defining discrete points in a reservoir;

defining a region of interest in the reservoir;

modeling permeability of structures comprising the reservoir;

computing, via a computer, based on the modeled permeability, a time of flight for streamlines from each production well to each point;

computing, via a computer, based on the modeled permeability, a time of flight for streamlines from each injection well to each point;

summing, via a computer, the computed times of flight for at least a portion of the reservoir, wherein summing comprises summing production well and injection well times of flight for each point within the region of interest of the reservoir;

determining a current production for each production well;

setting a threshold value based at least in part on the current production;

mapping, via a computer, the summed times of flight for the region of interest;

displaying the mapped times of flight using a color scale, wherein the color scale provides a visual identification of the areas of the reservoir that are likely to include bypassed resources; and identifying areas having a summed time of flight that exceeds the threshold value as areas of the reservoir that are likely to include bypassed hydrocarbon resources in the reservoir.

9. A method in accordance with claim 8, wherein time of flight is computed using a fast marching algorithm.

10. A method in accordance with claim 8, further comprising, drilling into the identified areas to access the bypassed resources.

11. A method in accordance with claim 10, wherein the drilling comprises drilling an additional production well.

12. A method in accordance with claim 10, wherein the drilling comprises drilling an additional injection well.

13. A method in accordance with claim 10, wherein the drilling comprises horizontal drilling from an existing production well.

14. A method in accordance with claim 8, wherein modeling the permeability is based at least in part on data obtained from well logs.

15. A method in accordance with claim 8, wherein the modeling the permeability is based at least in part on seismic data.

* * * * *